US010537905B2

(12) United States Patent
Knight

(10) Patent No.: US 10,537,905 B2
(45) Date of Patent: Jan. 21, 2020

(54) FOAM DISPENSERS

(71) Applicant: RIEKE PACKAGING SYSTEMS LIMITED, Leicestershire (GB)

(72) Inventor: Simon Christopher Knight, Bridgend (GB)

(73) Assignee: RIEKE PACKAGING SYSTEMS LIMITED, Bridgend (GB)

( * ) Notice: Subject to any disclaimer, the term of this patent is extended or adjusted under 35 U.S.C. 154(b) by 0 days.

(21) Appl. No.: 15/579,609

(22) PCT Filed: Jun. 6, 2016

(86) PCT No.: PCT/GB2016/051665

§ 371 (c)(1),
(2) Date: Dec. 5, 2017

(87) PCT Pub. No.: WO2016/193764

PCT Pub. Date: Dec. 8, 2016

(65) Prior Publication Data

US 2018/0154379 A1 Jun. 7, 2018

(30) Foreign Application Priority Data

Jun. 5, 2015 (GB) ..... 1509828.8

(51) Int. Cl.
*B05B 7/00* (2006.01)
*B05B 11/00* (2006.01)

(52) U.S. Cl.
CPC ..... *B05B 7/005* (2013.01); *B05B 11/3052* (2013.01); *B05B 11/3067* (2013.01); *B05B 11/3073* (2013.01); *B05B 11/3087* (2013.01)

(58) Field of Classification Search
CPC ..... B05B 11/3052; B05B 11/3067; B05B 11/3073; B05B 11/3087; B05B 7/005;
(Continued)

(56) References Cited

U.S. PATENT DOCUMENTS 3,973,701 A * 8/1976 Gardner ..... A45D 40/00 222/190
4,105,145 A * 8/1978 Capra ..... B05B 9/0883 222/340

(Continued)

FOREIGN PATENT DOCUMENTS

DE 10108299 A1 1/2002
EP 1199105 A1 4/2002

OTHER PUBLICATIONS

International Search Report and Written Opinion dated Sep. 13, 2016; International Patent Application No. PCT/GB2016/051665, International Filing Date Jun. 6, 2016; ISA/EP.

*Primary Examiner* — Charles Cheyney
(74) *Attorney, Agent, or Firm* — McDonald Hopkins LLC

(57) ABSTRACT

A foam dispenser has a foam-generating pump (1) mounted on a container (100) to hold liquid. The pump (1) has a liquid intake conduit with a ball valve (27) and an air intake conduit (45) provided partly by a jacket component (4) fitting around the pump body (2) with clearance. The pump has structure defining a mixing zone (50) for mixing air and liquid, a foam chamber (28) for holding foam received from the mixing zone, and a discharge conduit leading from the foam chamber to a discharge outlet (36). The mixed air and liquid pass through a permeable foam regulator mesh (54). One or more air inlets (47) lead into the mixing zone (50) from the air intake conduit (45). A liquid inlet in the form of a restricted jet orifice (89) leads into the mixing zone (50) from the liquid intake conduit, upstream of the inlet ball valve (27). A regulator mesh (53) is also provided between the liquid inlet and mixing zone.

10 Claims, 5 Drawing Sheets

(58) Field of Classification Search
CPC . B05B 7/0037; B05B 11/043; B05B 11/0059; B05B 11/047; B05B 11/3001; B05B 11/046; B05B 11/3004; A47K 5/14
USPC ..... 222/190, 211, 321.9
See application file for complete search history.

(56) References Cited

U.S. PATENT DOCUMENTS 4,156,505 A * 5/1979 Bennett ..... B05B 11/043 222/212
4,274,594 A * 6/1981 Ito ..... B05B 7/0037 222/190
4,509,661 A * 4/1985 Sugizaki ..... B05B 11/043 222/190
4,615,467 A * 10/1986 Grogan ..... B05B 11/043 222/190
4,932,567 A * 6/1990 Tanabe ..... B05B 7/0062 222/190
5,219,102 A * 6/1993 Wright ..... B05B 7/0037 222/190
5,462,208 A * 10/1995 Stahley ..... B05B 7/0037 222/190
5,570,819 A * 11/1996 Uehira ..... B05B 7/0037 222/190
6,446,840 B2 * 9/2002 Ophardt ..... B05B 7/0037 222/190
6,536,685 B2 * 3/2003 Bennett ..... B05B 7/0037 239/337
7,850,049 B2 * 12/2010 Ciavarella ..... A47K 5/14 222/190
8,499,981 B2 * 8/2013 Quinlan ..... A47K 5/14 222/136
2007/0119864 A1 5/2007 Tsai
2014/0107224 A1 * 4/2014 Osman ..... A61K 9/0019 514/723

* cited by examiner

FOAM DISPENSERS

CROSS REFERENCE TO RELATED APPLICATIONS

This application is a 35 U.S.C. 371 national stage filing and claims priority to pending International Application No. PCT/GB2016/051665 filed on Jun. 6, 2016, entitled "FOAM DISPENSERS," which claims the benefit of Foreign Patent Application No. GB1509828.8 filed on Jun. 5, 2015, each of the foregoing applications are incorporated by reference herein.

This invention has to do with foam dispensers operable by hand; and particularly but not exclusively foam dispensers operable by a pumping action with reciprocation of a plunger.

BACKGROUND

Pump action hand foamers are well-known in the art. Generally they comprise a container for holding foamable liquid and a foam-generating device, typically comprising a plunger-operated pump, mounted in the neck of the container and having an inlet such as a dip tube communicating with the container interior to draw liquid into a pump chamber. To generate foam, the liquid must be mixed in appropriate proportion in air under turbulent conditions, with regulation as necessary to make the bubble size in the foam reasonably uniform. This is technically demanding and commercially important, because wet or non-uniform foams have low consumer acceptability.

One well-established pump type has separate pump cylinders for the air and liquid, with respective inlet valves and pistons carried by a single plunger. The corresponding air liquid outlets open into a mixing chamber downstream of the pump chamber—usually in the neck region of the dispenser above the pump cylinders—and the thus-mixed, liquid and air passed through one or more meshes to regulate the foam. These dispensers mix well-defined proportions of air and liquid, but they are large and expensive, and not generally susceptible of a lock-down structure so that a separate cap must be provided. See e.g. EP-A-0565713, EP-A-0613728, WO97/13585 and EP-A-1190775.

Separately, it has been proposed to make a pump foamer by drawing both air and liquid together into a pump chamber operated by a piston, under conditions promoting turbulent mixing so that the chamber fills with foam, the foam then being expelled through the pump outlet e.g. through a plunger stem. In US2007/0040048A a conventional piston/cylinder plunger pump is fitted with a dip tube extending down to the container bottom, where the dip tube has a small hole, and up again to the top of the container where the dip tube end opens in the air above the liquid in the container. The pump action draws air rapidly through the dip tube, entraining a small proportion of liquid through the entry hole at the bottom of the container as it passes towards the pump. WO01/39893 describes introducing air through a separate air intake conduit defined by an outer cylindrical jacket fitting around the pump cylinder with some clearance and opening inside the container neck, so that air from the container interior can pass down between the jacket and pump body to the inlet region, entering beneath an inlet flap valve side-by-side with liquid from a conventional dip tube. WO2008/133491 describes an inlet fitting which adds an extra ball valve beneath a pump inlet valve, and vents in air from the container interior between the valves to mix with the liquid. WO2011/144861 also describes double inlet ball valves, with air inlet jets and a mixing mesh between them.

THE INVENTION

An aim herein is to provide new and useful foam dispensers, particularly of the hand-operable plunger-actuated type, with particular reference to novel inlet structures for air and/or liquid and arrangements for mixing these.

In one aspect the invention provides a foam dispenser comprising a container, to hold liquid in an interior thereof, and a foam-generating device mounted on the container. The foam-generating device comprises a liquid intake conduit for transferring liquid from the container interior, an air intake conduit for transferring air into the foam-generating device—either from the exterior or from the container interior—and structure defining a mixing zone (preferably a mixing chamber). The mixing zone has one or more air inlets from the air intake conduit and one or more liquid inlets from the liquid intake conduit for mixing of the air and liquid to form foam or foam precursor, mixing the air and liquid under turbulent conditions. The foam-generating device also comprises a foam chamber for holding foam, a discharge conduit leading from the foam chamber to a discharge outlet for dispensing foam, and an actuating means for driving foam from the foam, chamber along the discharge conduit to the discharge outlet; this may be by a pump action.

A check valve is desirably provided at an inlet to the foam chamber. Preferably one check valve controls the flow of both air and liquid (or precursor foam) into the foam chamber. Preferably the check valve is downstream of all or part of a said mixing zone/mixing chamber. The check valve may be e.g. a ball valve or a flap valve; a ball valve is preferred.

Preferably one or more porous or permeable foam regulator elements is provided through which mixed air and liquid (precursor foam) pass to make the bubble size more uniform. We prefer that at least one such foam regulator element is provided downstream of the foam chamber, preferably in the discharge channel, e.g. in or at the end of a discharge nozzle, such as at or adjacent the discharge outlet.

One or more porous or permeable regulator elements may be provided in the mixing zone or mixing chamber, desirably upstream of the mentioned inlet check valve. One or more regulator elements may be provided in the foam chamber. Any or each of these foam regulator elements may be a porous or perforated element, conveniently a mesh such as a polymer mesh.

The air intake conduit preferred herein is defined at least partly between a pump body component—which may define the foam chamber at its interior—and an air conduit surround or jacket component fitting around and/or against the exterior of the pump body with clearance between them to define all or part of the air intake conduit. An entry of the air intake conduit may be at the end of this jacket or surround component, such as adjacent an upper part, of the pump body e.g. at or adjacent a neck region of the container. Alternatively however the air inlet conduit may communicate to the container exterior. Other kinds of air intake conduit may be contemplated.

Particular proposals herein relate to structures provided for the introduction and mixing of air and liquid.

According to a first proposal, the liquid inlet to the mixing zone or mixing chamber has a restricted jet with a jet orifice at or adjacent the entry into the mixing zone or mixing chamber. Desirably the restriction of flow area at the jet orifice is down to 10% or less, preferably 5% or less of the cross-sectional, area of the liquid intake conduit upstream of the liquid inlet. Where the upstream liquid inlet, conduit varies in cross-sectional area, this % may be reckoned against the largest cross-sectional area thereof. Additionally or alternatively, the orifice maximum transverse dimension/diameter is usually not more than 1 mm, preferably not more than 0.8 mm, more preferably not more than 0.5 mm. Or, the preferred restriction may be defined in terms of the corresponding flow area (determined as for a circular opening; of the above dimension): usually not more than 0.8 $mm^2$, preferably not more than 0.5 $mm^2$, more preferably not more than 0.2 $mm^2$. Such dimensions are suitable for dispensers of a normal hand-held size with a range of conventional liquids.

To provide the restricted jet orifice, the foam-generating device may comprise an adaptor piece e.g. having a socket for plugging into or onto a discrete dip tube, the adaptor comprising a part defining the predetermined jet orifice (which of course is smaller than the internal diameter of a dip tube). The orifice-defining portion may be a piece separable from the adaptor so that different orifice sizes can be assembled according to the product to be dispensed.

While a single liquid inlet orifice is found to be suitable, it is possible to provide plural jet orifices provided that they constitute a restriction of the flow area relative to the liquid intake conduit. The area ratios above may be applied to the individual or collective jet openings of a plurality of openings.

It is also preferred that the liquid after passing through the jet passes next through a permeable porous regulator member such as a mesh, e.g. a polymer mesh. It may pass through a closed bore between the jet and the regulator member. The regulator member may cover the end of a tubular component defining this bore.

A second proposal herein concerns the sequence of flow structures at the inlet of the foam-generating device. According to this proposal the device comprises an inlet check valve at the entrance to the foam chamber. The mixing zone/chamber is upstream of this check valve. The liquid enters the mixing zone/chamber through the liquid inlet which communicates directly with the supply of liquid in the container interior (that is, not via a check valve), such as via a jet or orifice opening as proposed above. One or more air inlets also opens into the mixing chamber from the air intake conduit, as mentioned previously. Thus air and liquid may enter the mixing chamber directly, without previous valving of the liquid flow, and mix turbulently before passing through the check valve to the foam chamber. The check valve is desirably a ball valve, although a flap valve or other valve may be used.

A third proposal herein is that whereas at least one air inlet and at least one liquid inlet open into the mixing zone/mixing chamber, the or each liquid inlet enters the mixing chamber passing through a permeable or porous regulator element such as a mesh, whereas the, each or at least some of the one or more air inlets enter the mixing chamber directly, that is without passing through a permeable or porous regulator element.

While previous proposals have emphasised passing a preliminary mixture of air and liquid through a mesh together to regulate the size of foam bubbles, we find that good results can be achieved in a preferred device where only the liquid passes through a mesh (or other porous/permeable member) and the air is introduced separately, desirably meeting the liquid after the mesh. Of course, a supplementary mesh/regulator may be provided if wished e.g. in the mixing chamber or foam chamber. However we find that sufficient foam formation and foam regularity is achieved by having one or more supplementary mesh meshes in the discharge conduit, without the need for further regulator meshes in the mixing chamber or foam chamber.

Accordingly, the skilled person will realise that the present proposals provide for a relatively simple inlet structure for a foam-generating device such as a foam dispenser pump, in that a single valve and a single mesh can be used at the inlet end. Preferably there is no mesh or other regulator in the foam chamber.

In general, and in particular in any or all of the present proposals, it is preferred that one or more air inlets are formed as jets or restrictions relative to an upstream area of the air intake conduit, to promote high air speed and/or turbulence in the mixing zone or chamber. Such restrictions are conveniently formed or defined between slide-fitting surfaces of respective discrete components of the dispenser, such as tubular connector portions, by means of one or more grooves in one or both of these surfaces, providing a part of the air intake conduit communicating to one or more respective air inlet openings leading into a mixing chamber or mixing zone. The connecting components may be e.g. components of an inlet adaptor structure providing a junction or mixing zone where a liquid inlet conduit meets an air intake conduit, desirably at the inlet of a foam, chamber which may have an inlet check valve.

The total cross-sectional area at the one or more such restricted air inlets may be less than the total cross-sectional area of one or more restricted liquid inlets, e.g. of one or more restricted jet orifices. Preferably there are plural air inlets. The total air inlet restricted area may be e.g. less than 0.5 $mm^2$, or less than 0.3 $mm^2$ or less than 0.1 $mm^2$.

A further proposal herein is a combination of the structure elements enabling the provision of flow structures according to any one of the previous proposals. According to this proposal a body cylinder defining the foam chamber and having an inlet valve comprises a tubular connector at the inlet end. An air intake body, defining at least part of the air intake conduit between itself and the body cylinder, has a respective tubular connector which fits onto or into the tubular connector of the body cylinder, defining between them a mixing chamber bounded by the inlet valve at one end and an inlet opening of the air intake body tubular connector at the other end. One or more air inlet channels are defined e.g. between fitting surfaces of the respective tubular connectors, e.g. slidably-fitting surfaces, by means of one or more grooves in one or both of these surfaces, providing a final part of the air intake conduit communicating to one or more respective air inlet openings into the mixing chamber. A tubular connector, e.g. an oppositely-directed tubular connector of the air intake body, may connect the mentioned inlet opening to a dip tube or dip tube adaptor, e.g. a dip tube adaptor as described above which houses or defines a jet orifice for the liquid intake conduit. Where the dispenser is to be operated inverted a dip tube may be reversed or absent at the liquid inlet, as is known per se.

The foam-generating device preferably comprises a pump mechanism for expelling foam from the foam chamber through the discharge conduit. Thus, the foam chamber may be a pump chamber and the foam-generating device is a foam dispenser pump comprising an actuator moveable to alter the volume of the foam chamber to expel foam through the discharge conduit. Preferably the foam chamber is defined in a piston-cylinder pump, and desirably the piston is on a reciprocable plunger, reciprocable relative to a body of the pump comprising the cylinder.

As is known, the discharge conduit may run through the stem of such a plunger and to a discharge outlet which is on the head of such a plunger, e.g. at the end of a discharge nozzle thereof. One or more permeable regulator elements, such as a mesh, may be positioned spanning the discharge conduit in or on the plunger, conveniently at or adjacent the end of a discharge nozzle thereof and/or at a join between discrete parts forming the head and stem thereof, for practicality of assembly.

For generation of foam, it is necessary that the foam chamber be re-filled with foam resulting from inflow of liquid and air through their respective inlets and through the mixing chamber. Since a pump dispenser is desirably used, it is not necessary to squeeze the container. Rather, a return stroke of a reciprocating actuator (such as a plunger) of the pump (preferably under the influence of a return spring which is overcome by the user's force when expelling foam) draws in the necessary flows of air and liquid to generate fresh foam in the foam chamber. For this it is also usually necessary that a check valve action be provided in the discharge conduit so that suction is generated. We prefer that this check valve action be provided by a sliding-seal piston, relatively moveable to a stem of an actuator plunger, the stem having one or more flow openings for the passage of foam and the piston having a closure portion which in one position of the piston relative to the stem closes the flow opening(s), and in the other relative position leaves the flow opening(s). Movement between these positions conveniently entails "lost motion", wherein by friction of the piston against a cylinder wall, the piston lags behind the stem at the beginning of each movement. Such a sliding seal piston is known to the skilled person, but we note here that it is strongly preferable to the conventional outlet ball valve—which is desirably not used—for output of good quality foam through the discharge conduit in the dispensers disclosed herein.

In embodiments using a reciprocable plunger whose stem carries a piston, we prefer that the pump comprises an insert component which projects down into the pump cylinder from a top opening thereof and has a floor with an opening for passage of the plunger stem and which provides a seat for a pump return spring. The other end of the pump spring may act against an oppositely (usually downwardly) directed abutment of the plunger head. The plunger head may have a downwardly-projecting shroud portion to cover an upper part of the spring, so that this is not exposed. This construction can avoid contact of a metal spring with material being dispensed, while allowing full depression of the plunger e.g. so that it may be locked down onto a pump body of the foam-generating device. Thus, for example respective lock-down formations may be provided on the plunger head and at the top of the pump body which can be engaged by turning the plunger head relative to the body with the plunger head depressed. Because the present foam dispenser does not rely on a large air piston, but may be constructed with a freely rotatable plunger, it can take advantage of these enhancements which are not normally available with foam dispensers.

The pump spring may be a metal helical spring.

The volume of the foam chamber is not particularly limited, but will typically be 10 ml or less, typically 1 ml or more e.g. 2 to 6 ml.

The foam-generating device, such as a foam dispenser pump, may have a body which is fixed into the neck, of a container of foamable liquid by any generally known means, e.g. the body having an outward flange to be clamped down against the edge of the neck by a closure cap, comprised in the foam-generating device. The cap may engage the container neck by a threaded or snap engagement.

The respective dimensions of the air intake conduit and air inlet(s) and liquid inlet(s) are determined, in combination with the particular foamable liquid to be used, so that foam of a desirable consistency is produced. This is readily done by routine trials. As the skilled person is aware, with most liquids a desirable foam consistency is achieved at something like a 10:1 volume ratio of air:liquid, more generally between 8:1 and 12:1. We find that with the use of the present restricted orifice for the liquid and air, such suitable ratios are easily achieved and good quality foam produced, although the mixing of the foam may takes place (in typical embodiments) on the spring-powered retraction stroke of the actuator rather than under manual power as with a conventional two-piston foamer.

Further aspects of our proposals include a method of generating foam using a device of any kind proposed herein, and the foam-generating device adapted for attaching to the container but in the absence of the container.

An embodiment of our proposals is now described by way of example, with reference to the accompanying drawing figures in which.

Figure 3:
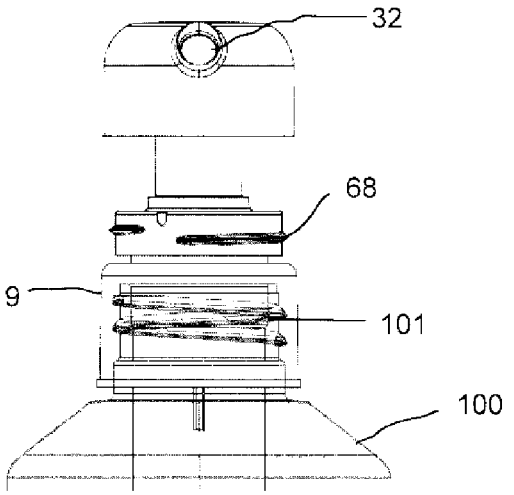
FIG. 3 is a fragmentary view showing the top of the pump connected to a container.

With reference to the drawing figures, a foam dispenser pump 1, being an embodiment of the foam-generating device of our proposals, comprises generally a pump body 2 including a cylinder 21 defining a pump chamber 28 which is a foam chamber for the device and a plunger 3 mounted to reciprocate relative to the body 2, with a spring 51 acting between them and tending to push the plunger 3 up to the extended position shown in the figures. The body 2 is mounted in the threaded neck 101 of a container 100—shown fragmentarily in FIG. 3—by a closure cap 9 having internal threads 91 and a top inward flange 92, The pump body has an outward mounting flange 24 at the top of the cylinder which rests on the container neck 101 and is clamped against it by the cap flange 92 through a seal ring 11. See FIG. 6. Above the mounting flange 24 the body 2 has an upward tubular top projection 25 with snap formations on its outer surface.

Figure 6:
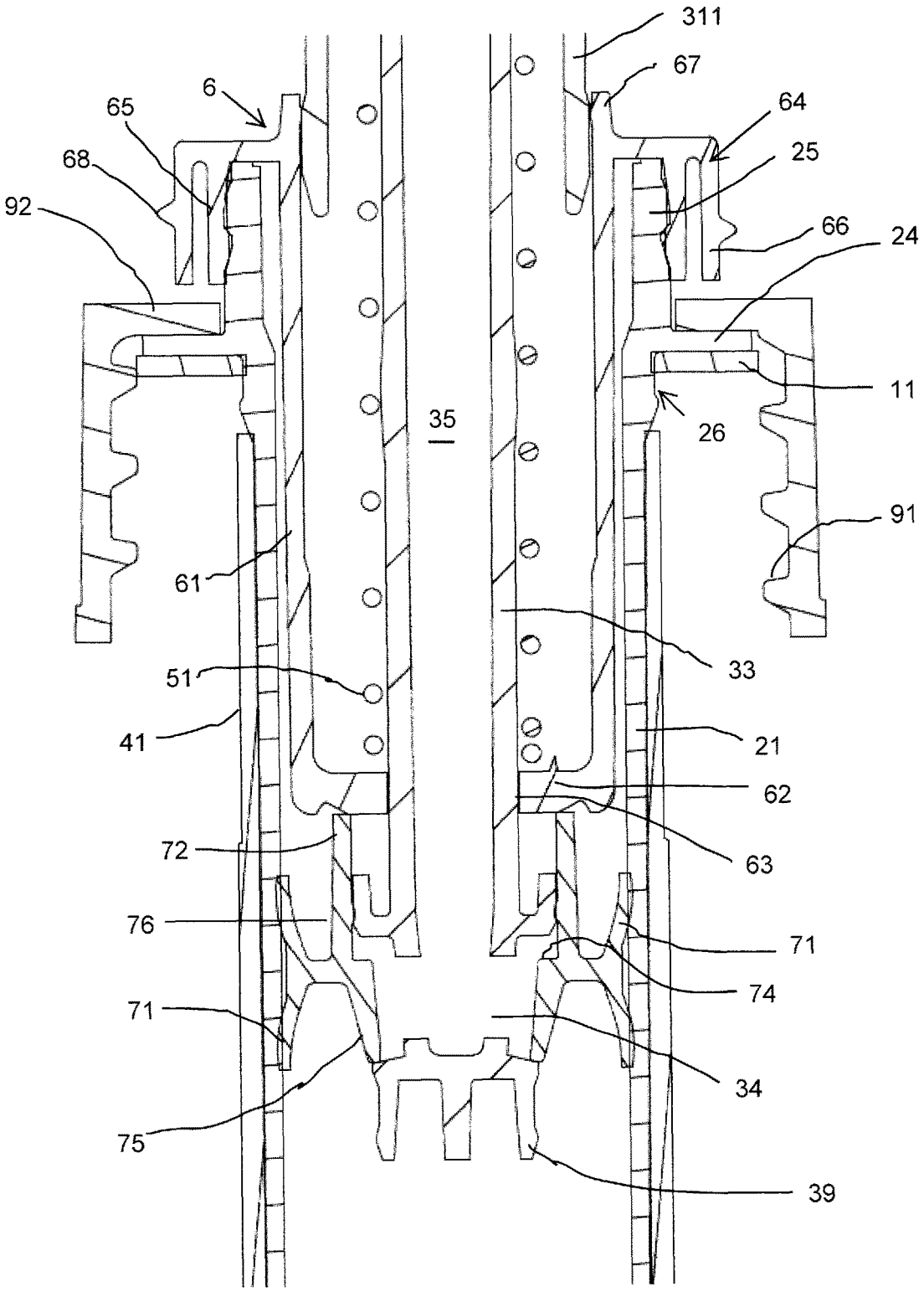
FIG. 6 is an enlargement of a central part of the pump in a sectional view as in FIG. 2.

A body insert 6, generally tubular in form, fits into the top of the cylinder 21—see FIG. 6. It has a generally cylindrical side wall 61 fitting with slight clearance into the cylinder to occupy an upper part thereof. It has an inturned floor 62 at the bottom with a central hole 63 for passage of the plunger stem 33, and a top collar 64 projecting first out and then down with a securing skirt. The securing skirt has an inner annulus 65 which snaps onto the securing snap formations of the top projection 25 of the body 2, and an outer annulus 66 which is spaced from it—and therefore not distorted when it is fitted on—and carries an external lock-down thread formation 68. The top of the body insert 6 has a circular opening for passage of the plunger, with a surround or lip 67 to contact the plunger exterior.

The plunger 3 is in many respects conventional for a movable-nozzle dispenser, having a tubular stem 33 plugged into a socket in the bottom of an actuator head 31 having a laterally-projecting nozzle 32 with a discharge outlet 36 at its end. Towards the top of the plunger, an inner dependent shroud 311 projects down from the plunger head at a spacing around the stem 33 to cover the spring 51 and slidably enter the body insert surround opening 67.

Figure 1:
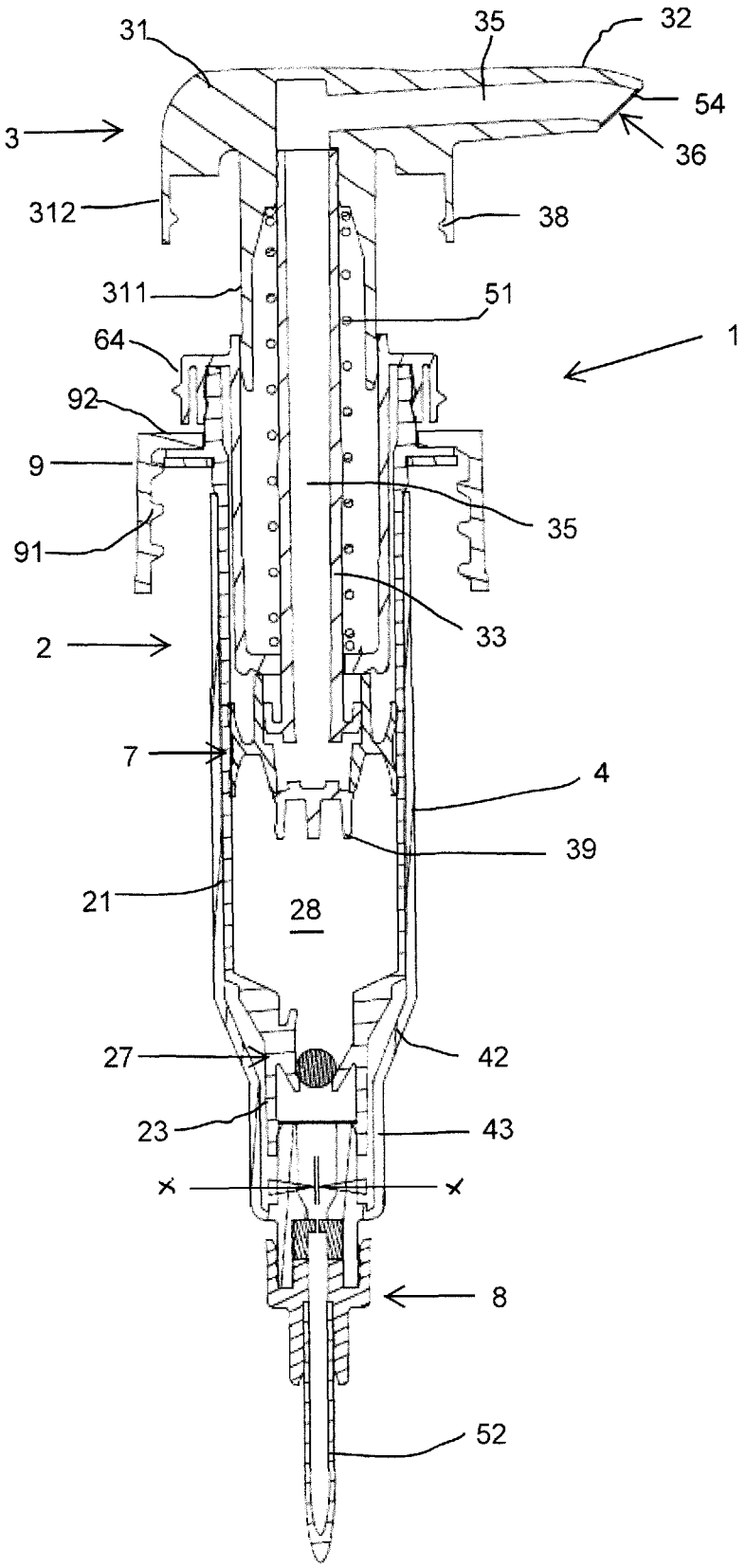
FIG. 1 is an axial cross-section, at a plane A-A marked in FIG. 2, of a foam-generating device embodying our proposals, specifically a foam dispenser pump.
Figure 2:
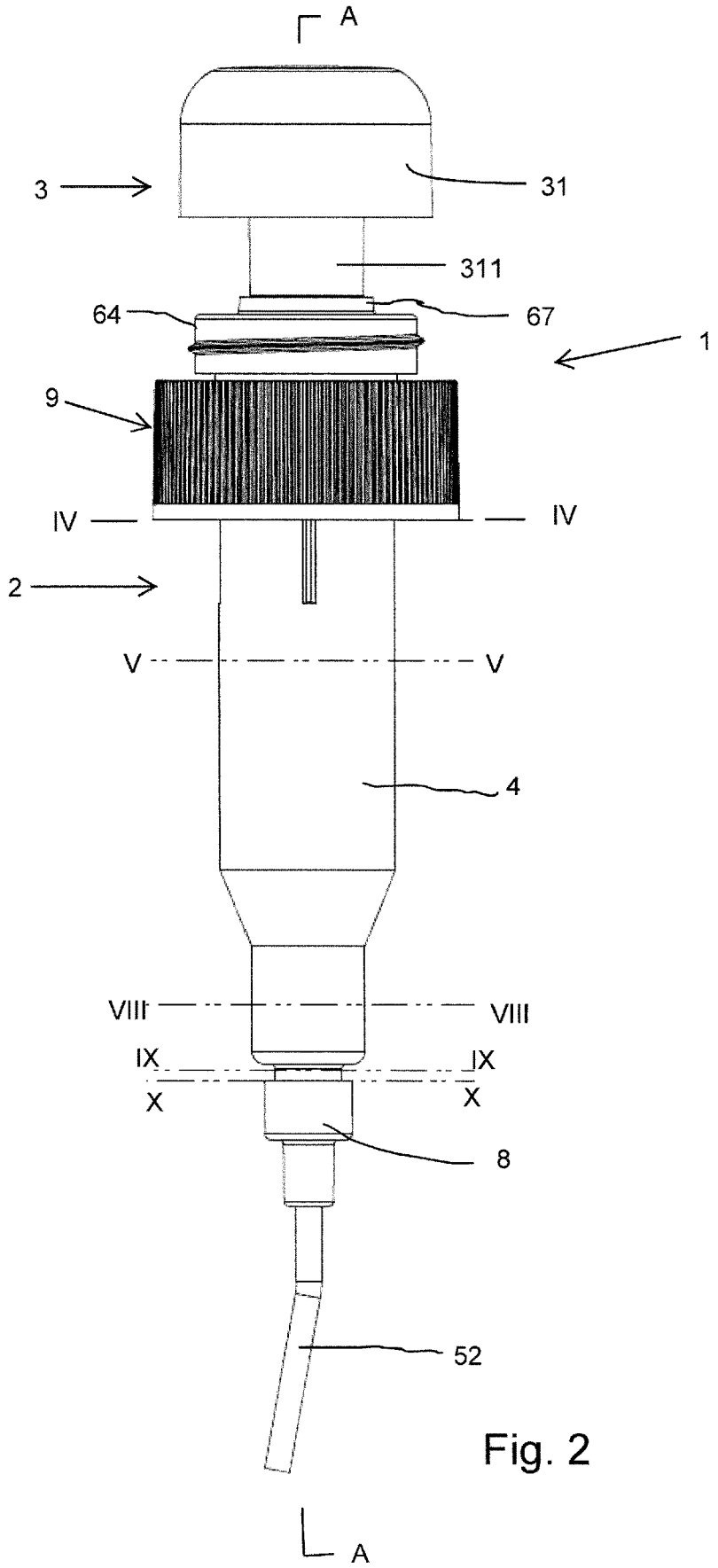
FIG. 2 is a rear elevation of the foam dispenser pump.
Figure 5:
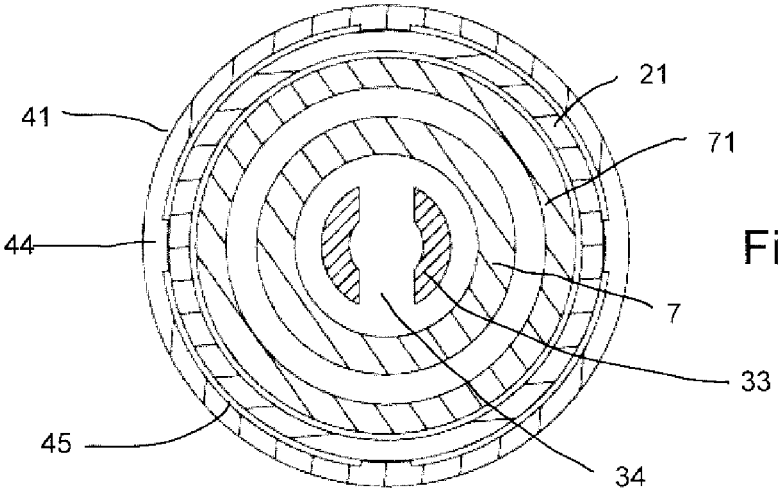
FIG. 5 is an enlarged radial cross-section at V-V of FIG. 2.

At its bottom end the stem 33 has a pair of flow windows 34 (FIGS. 1, 5 and 6) through which foam from the chamber 23 can enter the discharge conduit 35. The discharge conduit 35 is defined up inside the stem 33 and along inside the nozzle 32. To control the flow openings 34 and drive dispensing of foam the stem carries a sliding piston 7 having outwardly-directed sealing lips 71 wiping the inside wall of the cylinder 21 and an inner sleeve 76 comprising a top abutment ring 72 to engage against the underside of the floor 62 of the body insert 6, and a bottom closure skirt 75 which—as shown in the figures—can abut against a counter-surface of the stem 33 to close off the flow windows 34. Specifically, with the plunger 3 extended as shown under the force of the spring 51 (which is in compression) the stem 33 is pushed up relative to the piston 7, urging the closure skirt 75 against the counter-surface of the stem and preventing any flow. This relative position also holds when the plunger is rising after being depressed, so that suction in the chamber 28 draws liquid in through the inlet described below. When the plunger is pushed down, the stem 33 moves down before the piston 7—until the abutment shoulder 74 is engaged—so that the flow openings 34 open for the discharge of foam.

Returning to the plunger head 31; a nylon foam-regulator mesh 54 is bonded over the discharge outlet 36. This is a convenient place for attaching mesh and produces good foaming results. Or, a discrete end insert, of the nozzle (not shown) can be used to trap a mesh in place instead of bonding. Another option is to install a mesh inside/under the head at the top of the stem 33, where it can easily be trapped on assembly. Finally, the head has an outer dependent skirt 312 carrying inwardly-directed lock-down threads 38 which can be screwed onto the lock-down thread 68 of the collar 64 when the plunger is fully depressed. In this position an annular bottom projection 39 of the stem 33 seals around above the inlet valve 27 of the cylinder 21 so that product cannot escape from the pump e.g. during shipping.

Next, the special adaptations for forming foam are described. Most of the features described above except the mesh are present in normal liquid pump dispensers. In fact it is a virtue of our proposals that they can be embodied using largely conventional components, and indeed can be used to adapt a pre-existing liquid pump dispenser design to dispense foam instead.

Figure 4:
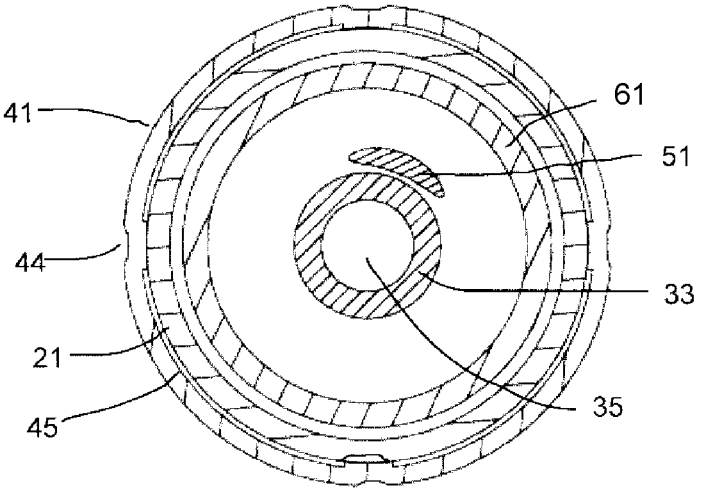
FIG. 4 is an enlarged radial cross-section at IV-IV of FIG. 12

An air jacket 4 with a generally cylindrical main wall 41 fits concentrically over the body cylinder 21, with its circular top edge approaching but not reaching the top of the cylinder 21 and with clearance between them at the top for air entry. The inside surface of the jacket wall 41 has shallow axial ribs 44 (see FIGS. 4 and 5) to maintain clearance between the jacket 4 and cylinder 21 for air flow; this constitutes part of an air intake conduit 45. Each of the cylinder 21 and jacket 4 has a convergent portion 22, 42 towards its lower end. In the cylinder 21 this convergent portion houses an inlet valve 27 with a valve ball 273, valve seat 271 and valve ball retainers 272 above. See FIG. 7. Below the inlet valve the body 2 has a downwardly-projecting cylindrical inlet end tube fitting 23.

Figure 7:
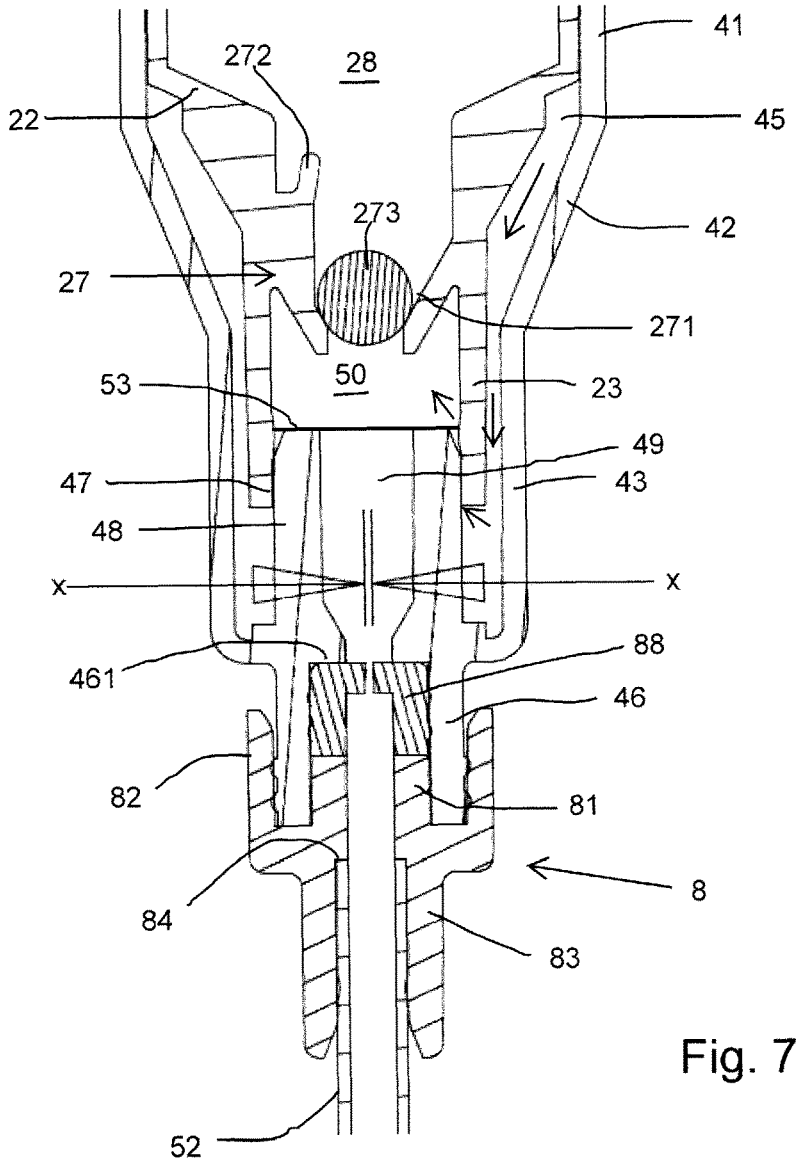
FIG. 7 is a corresponding enlargement of an inlet part of the pump.
Figure 8:
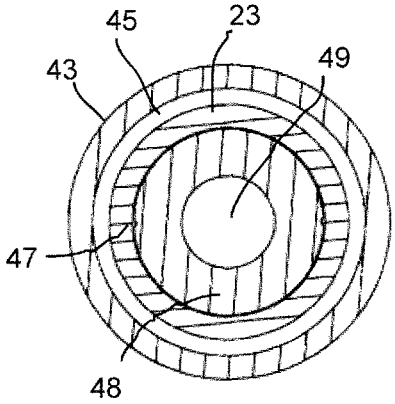
FIGS. 8, 9 and 10 are enlarged radial cross-sections at VIII-VIII, IX-IX and X-X of FIG. 2 respectively.
Figure 9:
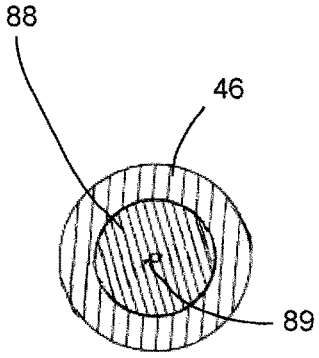
Figure 10:
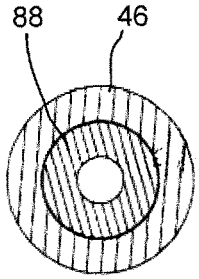

The convergent portion 42 of the air jacket 4 leads to a bottom tubular extension 43, and this stands at a radial clearance from the outside of the body 2 so that the air intake conduit 45 continues between them as indicated by arrows in FIG. 7. At its bottom end the jacket component 4 is formed with an inner upward fitting tube 48 and a coaxial downward fitting tube 46 both defining a central bore 49. The outside of the upward fitting tube 48 has a smooth cylindrical surface interrupted at diametrically-opposed points by two axially-extending grooves 47—see also the section of FIG. 8. The cross-sectional area of each of these grooves is e.g. from about 0.02 to about 0.05 $mm^2$, the total area of the combined grooves being e.g. from 0.04 to 0.1 $mm^2$. The top of the fitting tube 48 plugs into the bottom of the inlet end tube 23 of the body 2 with a close fit, excepting that the mentioned grooves or channels 47 provide for a restricted or jet air flow of corresponding area (by opposing plain cylindrical surfaces on the tube fitting 48) and are air inlets or air inlet jets constituting the final part of the air intake conduit 45 as indicated by the arrows in FIG. 7. They lead into the mixing chamber 50 defined by the inlet valve, the end tube 23 of the body and the upward fitting tube 48 of the jacket 4. A nylon regulator mesh 53 is bonded over the top of the upward fitting tube 48, covering the bore 49. This mesh does not cover or interfere with flow from the air channels or jets 47.

A dip tube adaptor 8 plugs into the cylindrical opening defined by the downward fitting tube 46 of the air jacket 4. Between the upward and downward fitting tubes 48, 46, where the jacket 4 defines the through-bore 49, a downwardly-directed annular shoulder 461 is provided and this provides a seat for a solid orifice piece 88, in the form of a short cylindrical cap with a small central orifice 89 or jet bored through its top layer. The jet orifice piece 88 is trapped in position by plugging the adaptor 8, which has a corresponding inner plug formation 81, into the downward fitting tube 46. The adaptor 8 also has an outer upward retaining skirt 82 and, projecting downwardly, a dip tube socket 83 with an internal stop shoulder 84 to position the end of the dip tube 52. In this particular embodiment the internal diameter of the dip tube 52, and of the adaptor 8 and orifice piece 88, is about 2 mm while the diameter x of the jet orifice 89 at the top of the orifice piece 88 is about 0.4 mm, so the orifice cross-sectional flow area is about 3 to 4% of that of the tube immediately upstream thereof.

Operation of the device is readily understood. The user repeatedly presses and releases the head 31 of the plunger 3. On each upstroke the seal of the sliding piston closes, suction is generated in the chamber 28 and both liquid and air are drawn towards the chamber, via the mixing chamber 50 and valve 27, from their respective inlets. Air for this purpose enters the top of the air jacket 4 recessed up inside the neck of the container, avoiding the entry of liquid. Liquid rises up the dip tube and enters through the narrow jet 89. The sizes of the restricted inlet openings are selected so that the proportions of the liquid, arriving in a turbulent jet and passing through the mesh 53, and of air arriving at high velocity through the small inlet channels 47, are appropriate to form a foam.

A notable feature of this embodiment is that the air does not pass with the liquid through the first mesh 53. This is a desirable and distinctive feature, although alternative constructions can be used.

The inlet valve 27 is open under the suction conditions, so the resulting foam precursor, i.e. turbulently mixed liquid and air in the form of a non-homogeneous foam, fills the pump chamber 28. When the plunger is depressed again, the inlet valve 27 closes, the sliding seal piston 7 opens and foam from the chamber 28 is expelled up the discharge conduit 35 and out through the outlet 36 by way of the second mesh 54 which regularises the bubble size. The dose volume is about 0.4 ml in this embodiment.

It is surprising that foam of good quality can be made and dispensed with such a simple inlet and outlet structure, and with so few meshes/regulators. The use of restricted jet inlets for the liquid, and desirably also for the air, is found to give a good tolerance of the device to varying conditions. In particular, known foamers often perform poorly when the liquid becomes aerated, e.g. if the container has been shaken. The present foamer is found to perform well even under these conditions.

The proportions of air and liquid can readily be adjusted e.g. by adjusting the size of the liquid inlet jet 83. While the jet is provided as a separate component in the present embodiment, this is primarily for versatility. The jet could be provided as a fixed portion of the inlet tube adaptor 8. Indeed the inlet tube adaptor 8 could be integrated with the bottom of the jacket component 4.

While the present embodiment shows an air conduit 45 defined by jacket 4 surrounding the pump cylinder 21, this is not in itself a novel proposal, Other dispositions of air intake conduit may be used, drawing air either from the container interior as in the present embodiment, or from an intake entry at the outside of the device.

Provision is made for air to enter the container, to compensate for dispensed liquid volume, via vent openings 26 (marked in FIG. 6 but not visible per se) around the top of the cylinder 21.

The invention claimed is:

1. A foam dispenser comprising a container to hold liquid and a foam-generating device mounted on the container;

the foam-generating device comprising a liquid intake conduit, an air intake conduit, structure defining a mixing chamber for mixing air and liquid from these conduits, a foam chamber for holding foam received from the mixing chamber, a discharge conduit leading from the foam chamber to a discharge outlet and an actuator for driving foam from the foam chamber along the discharge conduit to the discharge outlet;

one or more air inlets opening into the mixing chamber from the air intake conduit and one or more liquid inlets opening into the mixing chamber from the liquid intake conduit;

the or each said liquid inlet entering the mixing chamber by way of a permeable regulator element including a mesh, a check valve between the permeable regulator element and the discharge outlet;

a body component defining the foam chamber and an air conduit jacket component fitting around the body with clearance between the jacket component and the body providing all or part of the air intake conduit; and wherein the or each said air inlet enters the mixing chamber directly without passing through a permeable regulator element.

2. The foam dispenser of claim 1 wherein the check valve is positioned between the mixing chamber and the foam chamber.

3. The foam dispenser of claim 1 wherein a said liquid inlet comprises a restricted jet with a jet orifice.

4. The foam dispenser of claim 3 wherein the liquid inlet has a closed bore between the restricted jet orifice and the regulator element, and the air inlet(s) is/are outside the closed bore.

5. The foam dispenser of claim 1 wherein the or each air inlet comprises a restricted jet.

6. The foam dispenser of claim 1 wherein the flow cross-section area of the one or more air inlets is less than the flow cross-section area of the one or more liquid inlets.

7. The foam dispenser of claim 1 wherein the foam-generating device comprises a pump mechanism for expelling foam from the foam chamber through the discharge conduit, the foam chamber being a pump chamber of said pump mechanism and the actuator being moveable to alter a volume of the foam chamber to expel foam through the discharge conduit.

8. The foam dispenser of claim 1 wherein one or more air inlets of the air intake conduit are defined as channels between fitting surfaces of discrete components of the foam-generating device.

9. The foam dispenser of claim 1 wherein a volume of the foam chamber is from 1 ml to 10 ml.

10. The foam dispenser of claim 1 wherein one or more permeable foam regulator elements is provided in the discharge conduit or at the discharge outlet.

* * * * *